United States Patent [19]

Mori

[11] Patent Number: 4,638,771

[45] Date of Patent: Jan. 27, 1987

[54] LUBRICATING SYSTEM FOR TWO-CYCLE INTERNAL COMBUSTION ENGINE

[75] Inventor: Atsushi Mori, Iwata, Japan

[73] Assignee: Sanshin Kogyo Kabushiki Kaisha, Shizuoka, Japan

[21] Appl. No.: 868,203

[22] Filed: May 27, 1986

Related U.S. Application Data

[63] Continuation of Ser. No. 660,748, Oct. 15, 1984, abandoned.

[30] Foreign Application Priority Data

Oct. 24, 1983 [JP] Japan ..... 58-197659

[51] Int. Cl.[4] ..... F02B 33/04

[52] U.S. Cl. ..... 123/73 AD

[58] Field of Search ..... 123/73 AD

[56] References Cited

U.S. PATENT DOCUMENTS

| | | | |
|---|---|---|---|
| 3,886,914 | 6/1975 | Ahrns et al. | 123/73 AD |
| 4,121,631 | 10/1978 | Jones | 123/73 AD |
| 4,388,896 | 6/1983 | Sheridan et al. | 123/73 AD |
| 4,471,728 | 9/1984 | Borst et al. | 123/73 AD |
| 4,480,602 | 11/1984 | Kobayashi et al. | 123/73 AD |

OTHER PUBLICATIONS

Sales catalog—Electronic Gas/Oil Metering for 1980-82 OMC V-4, V-6 and OMC Sea Drive-TM Economixer.

*Primary Examiner*—E. Rollins Cross
*Attorney, Agent, or Firm*—Ernest A. Beutler

[57] ABSTRACT

A lubricating system for a two-cycle internal combustion engine of an outboard motor wherein lubricant is mixed with fuel before delivery to the charge formers of the engine. The amount of lubricant mixed with the fuel is varied in predetermined steps in response to the amount of fuel consumed by the engine.

14 Claims, 4 Drawing Figures

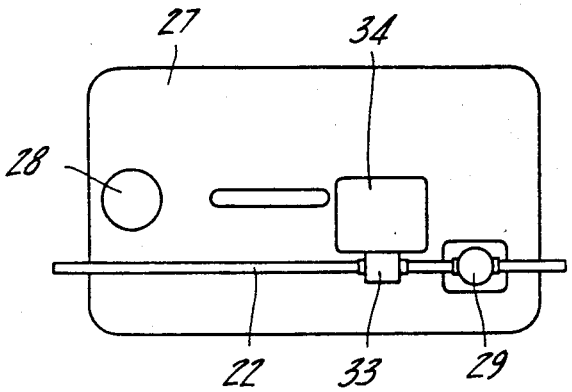
Fig-2
Fig-3
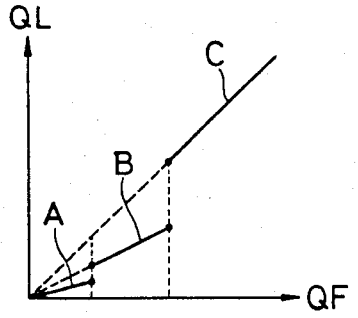
Fig-4
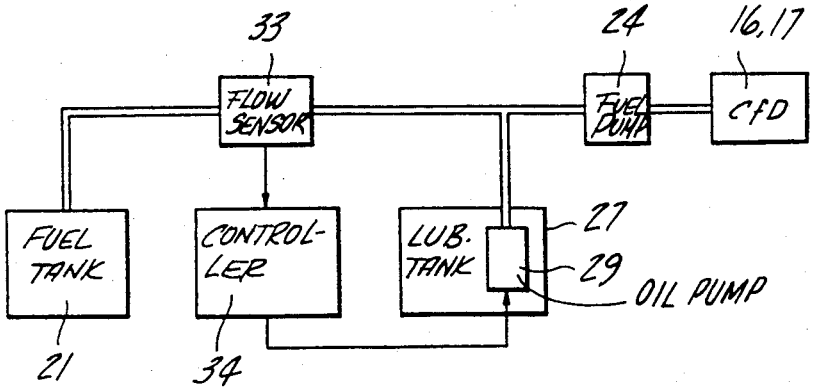

LUBRICATING SYSTEM FOR TWO-CYCLE INTERNAL COMBUSTION ENGINE

This is a continuation of U.S. patent application Ser. No. 660,748, filed Oct. 15, 1984, now abandoned.

BACKGROUND OF THE INVENTION

This invention relates to a lubricating system for two-cycle internal combustion engines and more particularly to an improved, simplified lubricating system for such engines.

In order to avoid the necessity for adding lubricant to the fuel of a two-cycle engine, it has been proposed to provide a positive lubricating system wherein lubricant is supplied automatically from a reservoir to the engine lubricating system. such devices not only eliminate the bother of having to mix lubricant with the fuel, but also can provide more accurate lubricant flow to suit the running conditions of the engine. However, the lubricating systems of this type which have been previously proposed are extremely complicated in nature and require the sensing of a number of engine running conditions so as to provide the controlled amount of lubricant.

In the copending application of Yoshiaki Kobayashi and myself, entitled "Lubricating System For Two-Cycle Internal Combustion Engine", Ser. No. 506,533, filed June 21, 1983 and now U.S. Pat. No. 4,480,602 and assigned to the assignee of this application, there is disclosed a simplified lubricating system for two-cycle engines wherein the amount of lubricant supplied is varied in accordance with only one sensed condition of the engine running. In that application, the sensed condition is engine running speed. Although such arrangements have particular advantage and good utility, it has been found desirable to vary the amount of lubricant in response to another sensed condition.

It is therefore, a principal object of this invention to provide an improved and simplified lubricating system for a two-cycle internal combustion engine.

It is another object of this invention to provide a lubricating system for a two-cycle internal combustion engine which is simple and yet which provides the requisite degree of lubricant under a wider range of conditions than prior art devices.

SUMMARY OF THE INVENTION

A first feature of this invention is adapted to be embodied in a lubricating system for two-cycle internal combustion engines having fuel feed systems including charge forming means and means for delivering fuel from a fuel source to the charge forming means. The engine also embodies a lubricating system. In accordance with this feature of the invention, means are provided for sensing the rate of fuel consumption and means supply lubricant to the eingine lubricating system at a rate determined only by the sensed rate of fuel consumption.

Another feature of the invention is also adapted to be embodied in a lubricating system for two-cycle internal combustion engines running over a variety of speed and load ranges and having a lubricating system for the engine. In accordance with this feature of the invention, means are provided for sensing a running condition of the engine and means are provided for controlling the rate of delivery of lubricant to the lubricating system at a first ratio when the sensed running condition is in a first range and at a second ratio when the sensed running condition is in another range.

A yet further feature of this invention is adapted to be embodied in a method for lubricating a two-cycle internal combustion engine that has a fuel feed system including charge forming means and means for delivering fuel from the fuel source to the charge forming means. In accordance with the method, the rate of fuel consumption is snesed and lubricant is supplied to the engine lubricating system at a rate determined by only the sensed rate of fuel consumption.

Yet a further feature of this invention is adapted to be embodied in a method for lubricating two-cycle internal combustion engines running over a variety of speed and load ranges and which have a lubricating system. In accordance with this method, a running condition of the engine is sensed and the rate of lubricant delivered to the lubricating system is varied at a first ratio when the sensed running condition is in a first range and at a second ratio when the sensed running condition is in another range.

BRIEF DESCRIPTION OF THE DRAWINGS

FIG. 2 is a top plan view of a portion of the lubricating system of the outboard motor.

FIG. 3 is a graphical view showing how the fuel/lubricant ratio is varied.

FIG. 4 is a schematic view showing the fuel feed and lubricating systems of the engine.

DETAILED DESCRIPTION OF THE PREFERRED EMBODIMENT

Figure 1:
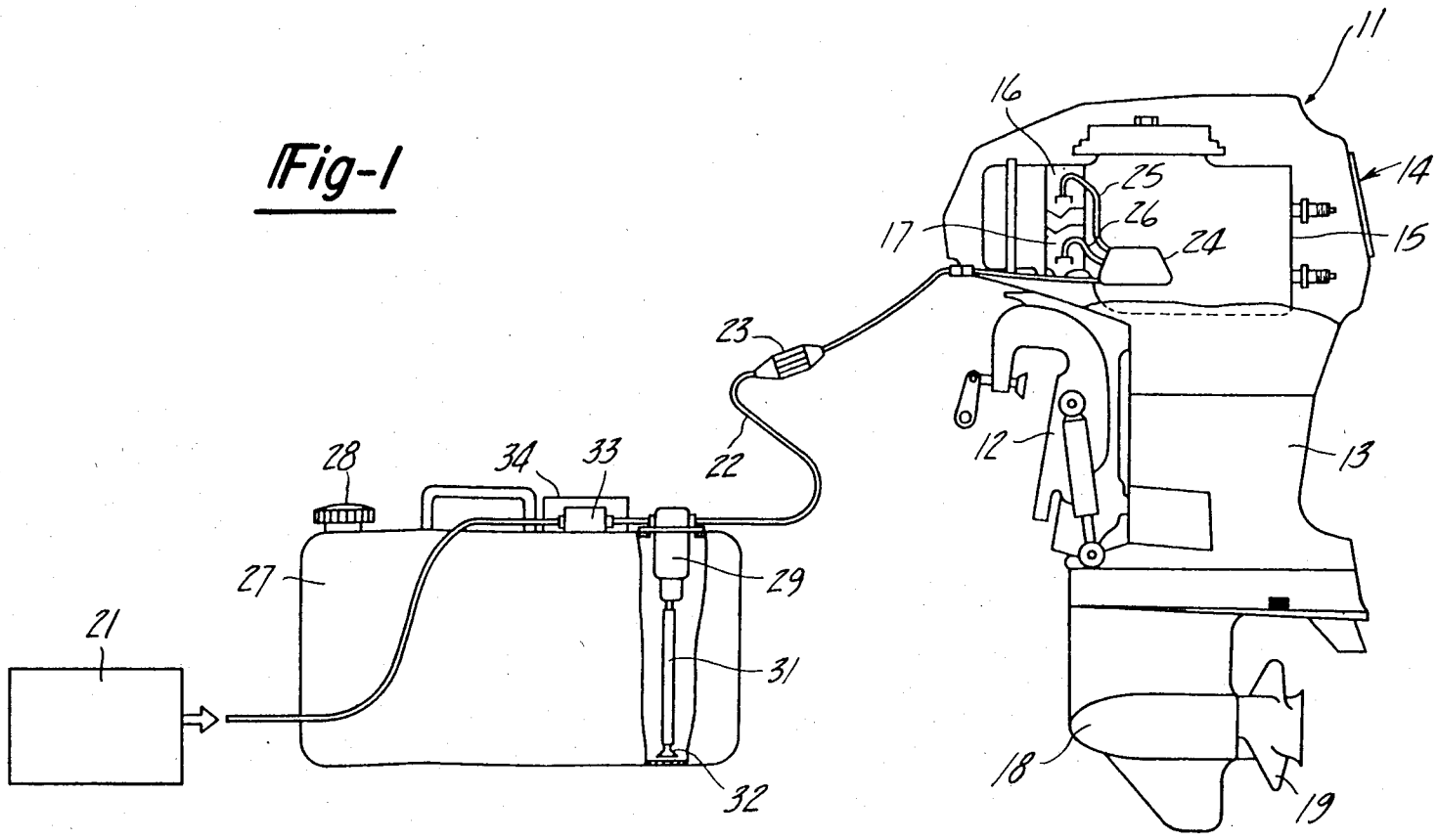
FIG. 1 is a side elevational view, with portions broken away and other portions shown schematically, of a two-cycle outboard motor constructed in accordance with an embodiment of the invention and lubricated in accordance with a method embodying the invention.

Referring to the drawings, an outboard motor constructed in accordance with an embodiment of the invention and lubricated in accordance with a method embodying the invention is identified generally by the reference numeral 11. The outboard motor 11 is adapted to be attached to a transom of a boat and, for this purpose, has a clamping bracket assembly 12. The clamping bracket assembly 12 is pivotally connected to a drive shaft housing 13 in a known manner for tilting movement about a horizontally extending axis and for steering movement about a vertically extending axis. A power head, indicated generally by the reference numeral 14 is positioned above the drive shaft housing 13 and contains a two-cycle internal combustion engine 15 which, in the illustrated embodiment, is of the crancase compression type. The engine 15 is depicted as having two cylinders and hence is supplied with a pair of carburetors 16 and 17 which supply fuel/air mixture to the crankcase chambers of the engine in a known manner. Rather than employing carburetors, it is to be understood that the invention may also be capable of use in engines having fuel injection. In addition, the invention is applicable to engines having other than two cylinders, as should be readily apparent to those skilled in the art.

A lower unit 18 is positioned beneath the drive shaft housing 13 and contains a propeller 19 that is driven from the engine 15 ina suitable manner.

The carburetors 16 and 17 are supplied with fuel from an appropriate fuel tank 21 which, in the illustrated embodiment, is remotely positioned. Fuel flows from the fuel tank 21 through a conduit 22 in which a manually operated priming pump 23 is provided to an engine driven fuel pump 24. The engine driven fuel pump 24 may be of any known type. Fuel is delivered from the fuel pump 24 to the carburetors 16 and 17 through respective supply conduits 25 and 26.

In accordance with the invention, the engine 15 is provided with a lubricating system that includes a remotely positioned lubricant tank 27 which may conveniently be carried within the hull of the associated watercraft. The tank 27 has a fill cap 28 that permits lubricant in the tank 27 to be periodically replenished. Lubricant is drawn from the tank 27 and delivered to the fuel conduit 22 for mixing with the fuel to supply a fuel lubricant mixture to the carburetors 16 and 17 by means of an electrically operated lubricant pump 29. The lubricant pump 29 is positioned in the lubricant tank 27 and has an inlet conduit 31 which depends to the lower portion of the tank 27 and at which an inlet strainer 32 is provided for removing foreign particles from the lubricant. The pump 29 has its output directed into an internal chamber through which the conduit 22 passes so that the lubricant delivered by the pump 29 will be mixed with the fuel flowing through the conduit 22.

In accordance with the invention, the amount of lubricant supplied by the pump 29 to the line 22 is varied i nresponse to only the amount of fuel being consumed by the engine 15. To this end, a fuel flow meter 33 is provided in the conduit 22 upstream of the point where the lubricant pump 29 communicates with it. A fuel flow signal is transmitted from the fuel flow sensor 33 to a control device 34. The control device 34 is internally programmed so as to vary the amount of lubricant delivered by the pump 29, in a proportion to be described, in response to the sensed fuel flow. It has been found that fuel flow is directly related both to engine speed and engine output torque and, hence, is a true indicator of the amount of lubricant required by the engine 15 during its operation. The manner in which the amount of lubricant may be controlled by the controller 34 may comprise varying either the output speed of the pump 29 or, alternatively, by varying its duty cycle so that it runs for longer periods of time or more frequently as more lubricant is demanded.

FIG. 3 shows the manner in which the controller 34 varies the amount of lubricant. Fuel flow is shown on the ordinate and is identified by the designation QF while oil or lubricant flow is shown on the abscissa and is identified by the character QL. The controller 34 is programmed so as to provide lubricant to the fuel at a relatively low ratio A during the lowest stage of fuel flow. At a certain fuel consumption, however, the controller 34 is programmed so as to increase the ratio of lubricant supplied to the fuel at the ratio B. At a still higher fuel consumption, the ratio of lubricant supplied by the controller 34 is increased to the ratio C. Although three steps have been illustrated, it is to be understood that a variety of steps may be incorporated without deviating from the invention. In addition, the lubricant flow may be mapped in a different manner, if desired. Various other changes and modifications may be made, without departing from the spirit and scope of the invention, as defined by the appended claims.

I claim:

1. In a lubricating system for a two-cycle internal combustion engine having a fuel feed system including charge forming means and means for delivering fuel from a fuel source to said charge forming means and a lubricant system for the engine, the improvement comprising means for measuring the amount of fuel supplied to said charge forming device and means for supplying lubricant to said engine lubricating system at a rate determined only by the measured amount of fuel supplied.

2. In a lubricating system as set forth in claim 1 wherein the ratio of lubricant supplied in response to the rate of fuel consumption is mapped to provide different ratios of lubricant fuel mixture at varying fuel consumptions.

3. In a lubricating system for a two-cycle internal combustion engine having a fuel feed system including charge forming means and means for delivering fuel from a fuel source to said charge forming means and a lubricant system for the engine, the improvement comprising means for sensing the rate of fuel consumption and means for supplying lubricant to said engine lubricating system at a rate determined only by the sensed rate of fuel consumption, the ratio of lubricant supplied in response to the rate of fuel consumption being mapped to provide different ratios of lubricant fuel mixture at varying fuel consumption, ratios being varied in stepped ranges.

4. In a lubricating system as set forth in claim 3 wherein the lubricant flow is controlled by providing a variable lubricant pump.

5. In a lubricating system as set forth in claim 4 wherein the lubricating system includes means for mixing the lubricant with the fuel before delivery to the charge forming means.

6. In a lubricating system as set forth in claim 1 wherein the lubricant flow is controlled by providing a variable lubricant pump.

7. In a lubricating system as set forth in claim 6 wherein the lubricating system includes means for mixing the lubricant with the fuel before delivery to the charge forming means.

8. A method of lubricating a two-cycle internal combustion engine having a fuel feed system including charge forming means and means for delivering fuel from a fuel source to said charge forming means and a lubricant system for the engine comrpising the step of measuring the rate of fuel consumption and supply lubricant to the engine lubricating system at a rate determined only by the measured rate of fuel consumption.

9. In a method as set forth in claim 8 wherein the ratio of lubricant supplied in response to the rate of fuel consumption is mapped to provide different ratios of lubricant fuel mixture at varying fuel consumptions.

10. In a method of lubricating a two-cycle internal combustion engine having a fuel feed system including charge forming means and means for delivering fuel from a fuel source to said charge forming means and a lubricant system for the engine comprising the step of measuring the rate of fuel consumption and supplying lubricant to the engine lubricating system at a rate determined only by the measured rate of fuel consumption, the ratio of lubricant supplied in response to the rate of fuel consumption being mapped to provide different ratios of lubricant fuel mixture at varying fuel consumptions, the ratios being varied in stepped ranges.

11. In a method as set forth in claim 10 wherein the lubricant flow is controlled by providing a variable lubricant pump.

12. In a lubricating system as set forth in claim 5 wherein the means for mixing lubricant with the fuel mixes lubricant with the fuel downstream of the means for sensing the rate of fuel consumption.

13. In a lubricating system as set forth in claim 7 wherein the means for mixing lubricant with the fuel mixes lubricant with the fuel downstream of the means for sensing the rate of fuel consumption.

14. A method as set forth in claim 8 wherein the lubricant is added to the fuel supply for lubricating the engine downstream of the point where the fuel consumption is measured.

* * * * *